United States Patent [19]

Sarsten

[11] 4,057,972

[45] Nov. 15, 1977

[54] FRACTIONAL CONDENSATION OF AN NG FEED WITH TWO INDEPENDENT REFRIGERATION CYCLES

[75] Inventor: Jan A. Sarsten, Millington, N.J.

[73] Assignee: Exxon Research & Engineering Co., Linden, N.J.

[21] Appl. No.: 682,331

[22] Filed: May 3, 1976

Related U.S. Application Data

[63] Continuation of Ser. No. 533,149, Dec. 16, 1974, abandoned, which is a continuation of Ser. No. 397,440, Sept. 14, 1973, abandoned.

[51] Int. Cl.[2] ..... F25J 3/06

[52] U.S. Cl. ..... 62/23; 62/40

[58] Field of Search ..... 62/9, 11, 40, 23, 36, 62/17, 18, 12

[56] References Cited

U.S. PATENT DOCUMENTS

| | | | |
|---|---|---|---|
| 3,418,819 | 12/1968 | Grunberg et al. | 62/11 |
| 3,763,658 | 10/1973 | Gaumer et al. | 62/40 |

*Primary Examiner*—Frank W. Lutter
*Assistant Examiner*—Frank Sever
*Attorney, Agent, or Firm*—H. N. Wells; R. D. Hantman

[57] ABSTRACT

A process for the liquefaction of natural gas which employs a multi-component refrigerant system and a second independent refrigeration system. The process differs from the prior art processes in that the feed gas is cooled only by the independent refrigeration system until it has been freed of those components which could precipitate as solids at the low temperatures of the liquefaction process and thereafter is cooled by the multi-component refrigeration system. The multi-component refrigerant system is a self-contained cycle and does not reject heat to the independent refrigeration system, but directly to the ambient temperature surroundings.

4 Claims, 4 Drawing Figures

ALT. COLD FEED

COLD FEED

FRACTIONAL CONDENSATION OF AN NG FEED WITH TWO INDEPENDENT REFRIGERATION CYCLES

This is a continuation of application Ser. No. 533,149, filed Dec. 16, 1974, now abandoned, which was a continuation of application Ser. No. 397,440, filed Sept. 14, 1973, now abandoned.

BACKGROUND OF THE INVENTION

Processes for the liquefaction of natural gas are principally of two main types. The classical method is the "cascade" refrigeration cycle, which is theoretically quite efficient. It provides a series of refrigerants selected so as to provide only small temperature differences between the refrigeration system and the natural gas being cooled. By using a sequence of refrigerants it is possible to cool natural gas from ambient temperature as received from wells or pipelines down to about −259° F., typical of LNG. Such a system is typified by U.S. Pat. No. 3,020,723. A principal characteristic of the cascade refrigeration cycle is that the coldest refrigerant discharges heat received from the natural gas into the next warmer refrigerant, which in turn discharges that heat along with the additional heat it receives from the natural gas to its next warmer refrigerant. This cascading is continued until finally all the heat is rejected to the ambient temperature surroundings by the warmest refrigerant.

While the cascade refrigeration system is efficient thermodynamically, it is mechanically complex since it requires many compressors, which is inherently undesirable. In addition, the efficiency of the liquefaction process is affected by the lower mechanical efficiency of smaller compressors. To avoid multiple compressors, other plants have used multi-component refrigerant (MCR) cycles which approximate the cascade system by using a multi-component refrigerant tailored to provide a cooling curve which approximates that of the liquefaction of natural gas but, having only a single refrigerant, can use a single compressor. See U.S. Pat. No. 3,593,535 for a typical MCR liquefaction process. The MCR refrigerant is composed of components having boiling points ranging from nitrogen to $C_6$ hydrocarbons. As an approximation of the operation of the cascade system, it is characteristic of MCR refrigeration cycles for a refrigerant stream to be removed from the cooling process and the heaviest components separated and then flashed for use as a refrigerant, and returned to the compressor. Thus, while the refrigerant is originally mixed, it is separated by successive flashing so as to provide the staging of the refrigeration temperatures which are needed to cool and condense natural gas. Such MCR cycles, while lacking the thermodynamic efficiency of the cascade cycle, cost less to build and operate since they require simpler equipment and permit the utilization of large-scale compressors which are inherently less expensive and more efficient mechanically than the multiple smaller units required for the cascade system.

A recent development and modification of the MCR refrigerant cycle is what has been called a "cold-suction" cyle. Such a system might be considered to be a hybrid between the cascade and MCR cycles in that the cold-suction cycle operates with cooling supplied from a separate refrigeration system at the warm end of the LNG liquefaction plant while still using an MCR cycle at the cold end of the plant. The MCR refrigerant in a cold-suction cycle does not warm up to the temperature of the incoming feed but instead is sent to the compressor suction while it is still cold and retains available refrigeration. Since the compressor horsepower is directly proportional to the absolute temperature at the suction of the compressor, substantial savings in compression horsepower can be achieved. A number of variants are possible and typical of these are described in applications Ser. Nos. 309,341 and 304,276 which are assigned to the same assignee as is the present application. The separate refrigeration may be a propane refrigeration system or alternatively, may be provided by a secondary loop established within the MCR refrigeration system. Both such refrigeration schemes are disclosed in the copending applications previously cited. A cold-suction cycle has two main disadvantages. First, while compression costs are reduced, additional heat exchangers and utilities are required, and secondly, supplying refrigeration to the warm end of the LNG plant from a separate refrigeration system is inherently less efficient thermodynamically than using the returning cold MCR refrigerant. In addition, additional complexity is introduced into the operation of the MCR refrigeration system when such extraneous refrigeration is supplied to it.

While the "cold-suction" refrigeration system has inherent cost advantages over the pure MCR cycle, its disadvantages suggest further improvement is required to reach an optimum refrigeration system. Overall, it may be said that the objective in the design of any such liquefaction process is to optimize capital costs and utilities while minimizing complexity in order to reduce manning and potential upsets. Such an improved system has been discovered and is the subject of the present application.

SUMMARY OF THE INVENTION

An improved process for the liquefaction of natural gas which uses the MCR refrigeration cycle but which foregoes the advantages of the cold-suction operation and maintains the warm suction typical of the MCR cycle requires no extraneous refrigeration to be supplied to the warm refrigerant after compression as is necessary in a cold-suction cycle. Refrigeration is supplied to the natural gas feedstream from an independent refrigeration system, thus creating a "cold feed" LNG liquefaction system. Both water and heavy hydrocarbons must be removed from the natural gas since they will precipitate out as solid particles during the low temperature liquefaction process. The extent of the feed cooling may be varied but, at a minimum, it is supplied until the temperature is reached where the natural gas must be dried to avoid hydrate formation. After drying, the natural gas is cooled by the MCR refrigeration cycle or, alternatively by the independent refrigeration system to the temperature at which heavy hydrocarbons are removed from the gas. This may be as low as the temperature available from the independent refrigerant system. For propane this is in the range of −40° F. After water and heavy hydrocarbons have been removed, the natural gas is cooled and liquefied by the MCR refrigeration system. Such a modified MCR refrigeration system has the distinct advantage of retaining the simplicity inherent in the MCR cycle while at the same time, by reducing the exchanger surface in the warm end of the MCR exchanger significantly reducing capital and operating costs.

DESCRIPTION OF THE PREFERRED EMBODIMENTS

In order to illustrate the interrelationship of the standard MCR refrigeration cycle, the "cold-suction" cycle, and those of the present invention, each have been illustrated and will be described below. The cascade refrigeration system is significantly different from the refrigeration cycles to be discussed and thus has not been illustrated.

Figure 1:
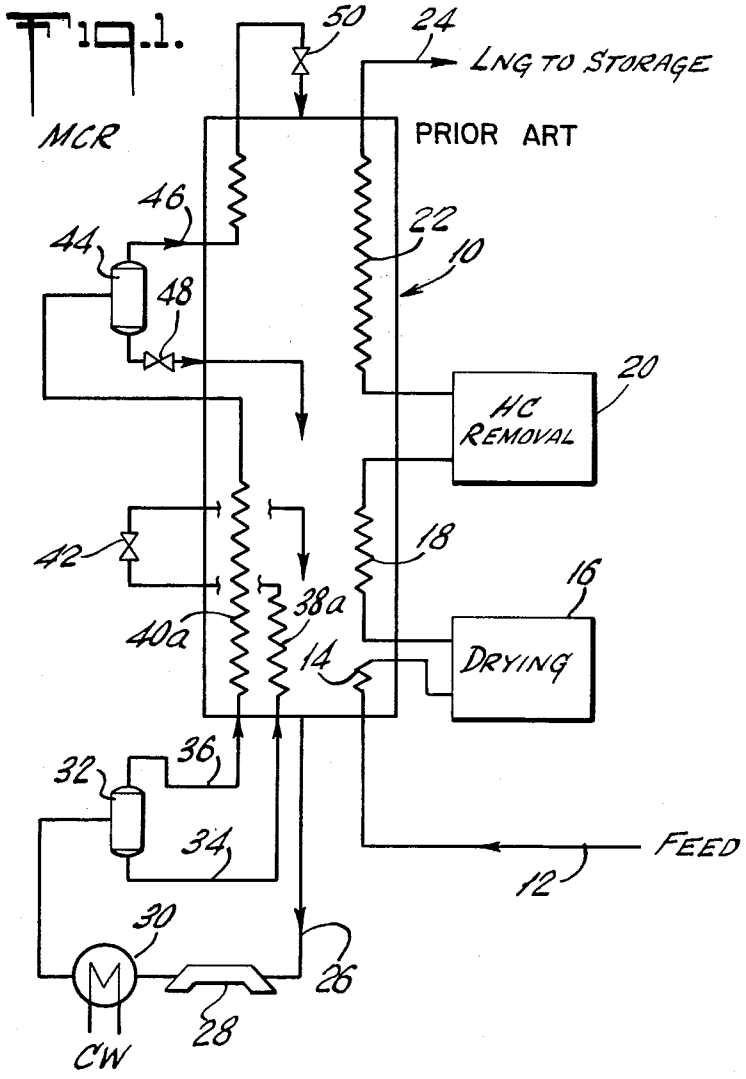
FIG. 1 illustrates the conventional MCR refrigeration cycle for liquefaction of natural gas.

In FIG. 1, a pure MCR refrigeration cycle for the liquefaction of natural gases has been illustrated in schematic form. The heat exchanger generally shown as 10 will typically be a single large spiral wound exchanger, which will include all of the cooling services which are required. Alternatively, the spiral wound exchanger may be replaced by individual exchangers such as plate-fin exchangers; however, it is convenient to refer to a single spiral wound exchanger as will be done hereinafter. Natural gas feed enters via conduit 12 at essentially ambient temperature. By ambient temperature is meant that temperature which is typical of the surroundings, that is the earth, the air, the water. The natural gas feed, having come from the earth or from a pipeline which has passed through the earth or the air, will have a temperature which closely approximates the ambient temperature, say 90°-100° F. In order to cool and liquefy this natural gas from ambient temperature to the low temperature of −259° F., much heat must be removed from the gas. In FIG. 1, feed is shown entering at the "warm end" of the exchanger 10. It is cooled in coil 14 and then is sent to drying equipment 16, which is located externally of the heat exchanger 10. Generally speaking, the lower the temperature which can be achieved before drying, the more efficient the drying process; however, it is important not to cool the gas too far since hydrates could form and cause plugging of the equipment. Drying accomplishes the removal of water so that hydrates and ice cannot form and thereafter the natural gas may be returned to the heat exchanger 10.

Many natural gases contain heavy hydrocarbons such as benzene which also may freeze out at the low temperatures of the liquefaction process. Thus, they also must be removed prior to cooling to those temperatures. Accordingly, the natural gas after drying is typically cooled further in coil 18 until the temperature is reached where these heavy hydrocarbons can be removed as a liquid phase. The cooled and partially liquefied natural gas is withdrawn from exchanger 10, the heavy hydrocarbons are removed at 20 and the gas is returned to the heat exchanger 10. Thereafter, the gas passes continually through the heat exchanger 10 in coil 22, which may alternatively be a sequence of heat exchange stages, until it has been condensed fully and passes out of the exchanger through line 24 into liquefied gas storage (not shown).

All of the cooling is provided in FIG. 1 by the MCR refrigeration loop, which as has been previously mentioned, approximates the operation of the cascade cycle in that a multi-component refrigerant comprising components ranging from nitrogen to $C_6$ hydrocarbons provides refrigeration at appropriate temperature levels by a process of successive condensation, separation and flashing. Beginning at the warm end of exchanger 10, warm gaseous refrigerant, warm referring here to a temperature near that of ambient but slightly below the temperature of the incoming feed gas, returns to the compressor 28 through line 26 and is compressed to the extent required to condense the gas against streams at ambient temperature, normally water or air. It should be noted here that all of the heat which has been removed from the cooling of the natural gas, is rejected to the air or water through the cooler-condensers 30 at the discharge of the compressor 28. In addition, the energy required to operate the compressor 28 is ultimately released to water or air through these heat exchangers. The heaviest portion of the refrigerant is condensed and the gas and liquid portions may be separated upstream of the heat exchanger 10. The refrigerant is separated in drum 32, the liquid stream 34 and the vapor stream 36 enter the heat exchanger 10 and are cooled in coils 38 and 40 by returning MCR refrigerant until they are removed for flashing. Only a single stage of separation and flashing is shown here, but in the typical process, this may well be a series of stages. The liquid stream 34, which had been separated upstream of the heat exchanger coil 38, is subcooled and then flashed. It is comprised of the heaviest components in the MCR refrigerant, which when flashed provide the warmest refrigerant, and consequently it is the first to be returned to the compressor. After cooling in coil 38 at the warm end of the exchanger 10, the liquid stream 34 is flashed at valve 42 and injected into the heat exchanger 10 where it combines with other returning refrigerant from the cold end of the exchanger 10. The vapor separated in drum 32, which enters the warm end of exchanger 10, is partially condensed during its passage through coil 40. It is separated in drum 44, the lighter components passing overhead as vapor and returning via line 46 to exchanger 10 where it repeats the process in the cold end of the exchanger 10. The liquid portion separated in drum 44 is flashed across valve 48 and returned to the heat exchanger 10. It will be noted that the gases from the separator drum 44 are lighter in composition than the entering stream, that is, they have had the heavy higher boiling hydrocarbon components substantially removed. Thus, when this vapor is further condensed in the colder portions of the exchanger, a refrigerant will be produced which is capable of reaching lower temperatures than the liquid which is first condensed. Thus by continually cooling and separating out the liquid, a series of refrigerants of varying temperature levels is formed which is suitable for cooling and liquefaction of the natural gas. At the end of the exchanger 10, the lightest components of the MCR refrigerant remain. They are flashed across valve 50 and returned to the cold end of the exchanger 10. The refrigerant passes through exchanger 10 to the compressor 28, cooling incoming refrigerant and natural gas. As the lightest refrigerant passes through exchanger 10, it is augmented by additional streams of flashed refrigerant at appropriate locations as typified by the liquids flashed at valves 42 and 48. This system is designed so as to produce a suitably close matching of refrigerant to cooling load and to prevailing natural gas temperatures throughout the exchanger to produce the most efficient liquefaction process. A single compressor is used even though a separation of the refrigerant is made in order to closely match the cooling load and temperatures.

Figure 2:
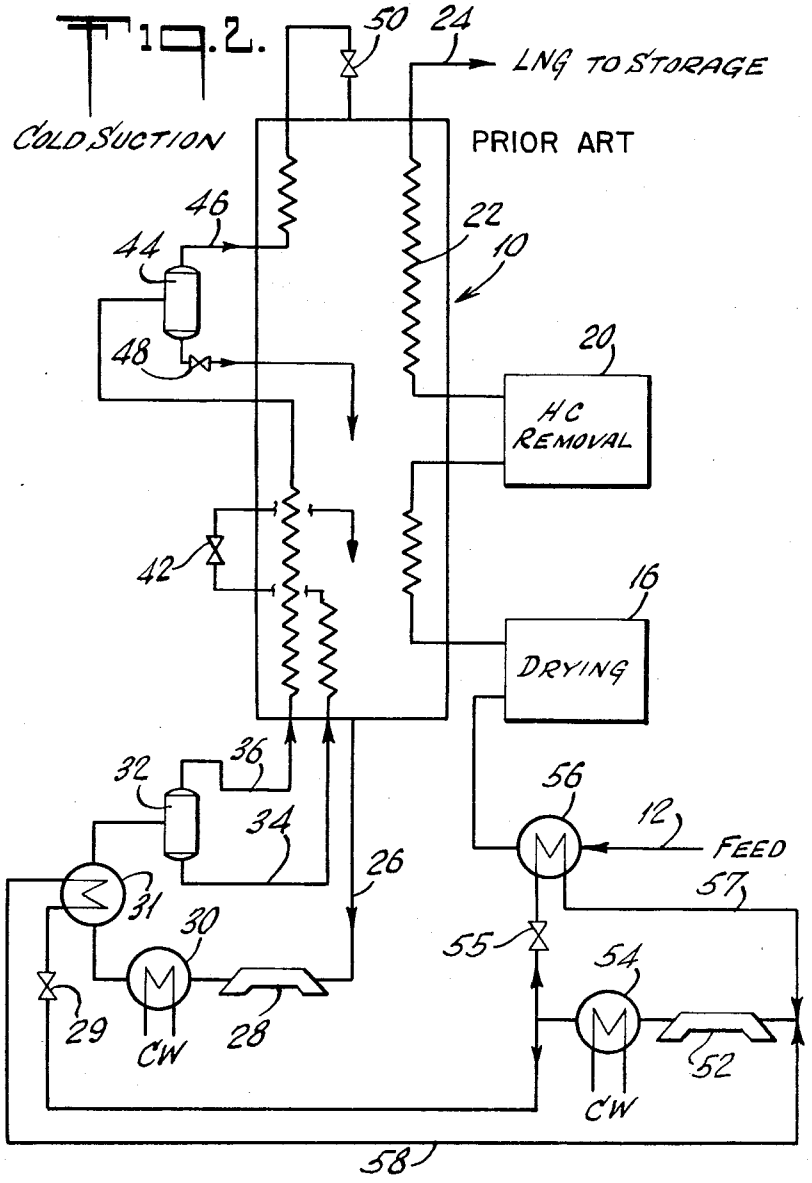
FIG. 2 illustrates the "cold-suction" modification of the MCR process.

Comparing FIG. 2, the so-called "cold-suction" refrigeration cycle, with standard MCR refrigeration cycle of FIG. 1, it can be seen that the principal difference between the two systems is that an independent refrigeration system has been introduced. A separate refrigerant, typically propane, would be used or disclosed in the copending applications, U.S. Ser. Nos. 309,341 and 304,276. It is possible also to use a secondary refrigeration loop established with the MCR system itself, also disclosed in the copending applications. The independent refrigeration system shown in FIG. 2 supplies cooling to the feed until the drying process has been accomplished and also supplies cooling to the warm MCR refrigerant. It is necessary to supply this cooling in order to operate a cold-suction cycle, that is, the refrigerant returning to the compressor via line 26 from the warm end of exchanger 10 in the cold-suction cycle is not warm in the sense of being approximately the ambient temperature as is typical of the incoming feed. Instead, in order to obtain the power savings derived from a low temperature compressor suction, the warm end of the heat exchanger 10 is actually sub-ambient. An optimum suction temperature would be selected for any particular plant, for example, in the region of 0° F. Since the heat to be removed from the incoming LNG plus the power input to the system must be rejected to the air or water from the aftercoolers 30, the temperature after these coolers will be slightly above ambient temperature, say for example, 100° F. In order to provide an efficient refrigeration system, it is necessary to cool the warm MCR refrigerant before it enters exchanger 10. Thus, while less horsepower is required for the cold-suction MCR compressor 28, additional compressor horsepower is required for independent refrigeration compressor 52. The cold-suction cycle is, in a way, a hybrid between the pure MCR and the cascade system of operation in that more than one refrigeration system is used, but the colder system rejects only part of its heat to the warmer system.

When all of the cost factors are included, that is, heat exchange surface, compressor horsepower, and utility requirements, the cold-suction cycle has economic advantages over that of the pure MCR cycle. It is nonetheless not without its disadvantages. The use of a separate refrigerant to cool MCR refrigerant somewhat less efficient than using MCR refrigerant since the temperature matching is inferior. Also, heavier components, which are condensed at relatively warm temperature in the pure MCR cycle, separated, and then cooled in the liquid phase (coil 38 in FIG. 1) in the warm end of the heat exchanger 10 must be cooled along with the vapor components in exchanger 31. Calculation has shown this to require more heat transfer surface than using a separate coil in exchanger 10.

The independent refrigeration system of FIG. 2 may be briefly described as follows. Starting at the warm end of the compressor 52, gas, assumed for convenience to be propane, is compressed to a pressure at which it can be economically condensed in exchanger 54 against ambient temperature streams, usually cooling water or air. Thereafter, the condensed refrigerant is passed to the beat exchanger 56 which cools feed and to exchanger 31 which cools warm MCR refrigerant. Just upstream of these exchangers, the refrigerant is flashed through valves 55 and 29 to a pressure approximating that of compressor suction and producing the temperature required for the cooling load. The refrigerant liquid vaporizes in the exchangers 56 and 31 to cool the feed and MCR refrigerant. Heat from the feed and from the warm MCR refrigerant vaporises the propane, after which it returns via conduit 57 and 58 to the warm end of the compressor 52 to return to complete the cycle. Note that the heat which is removed from the feed in exchanger 56 and from the warm MCR refrigerant in exchanger 31 plus the power to drive compressor 52 are all rejected to the environment through the compressor aftercooler 54.

Figure 3:
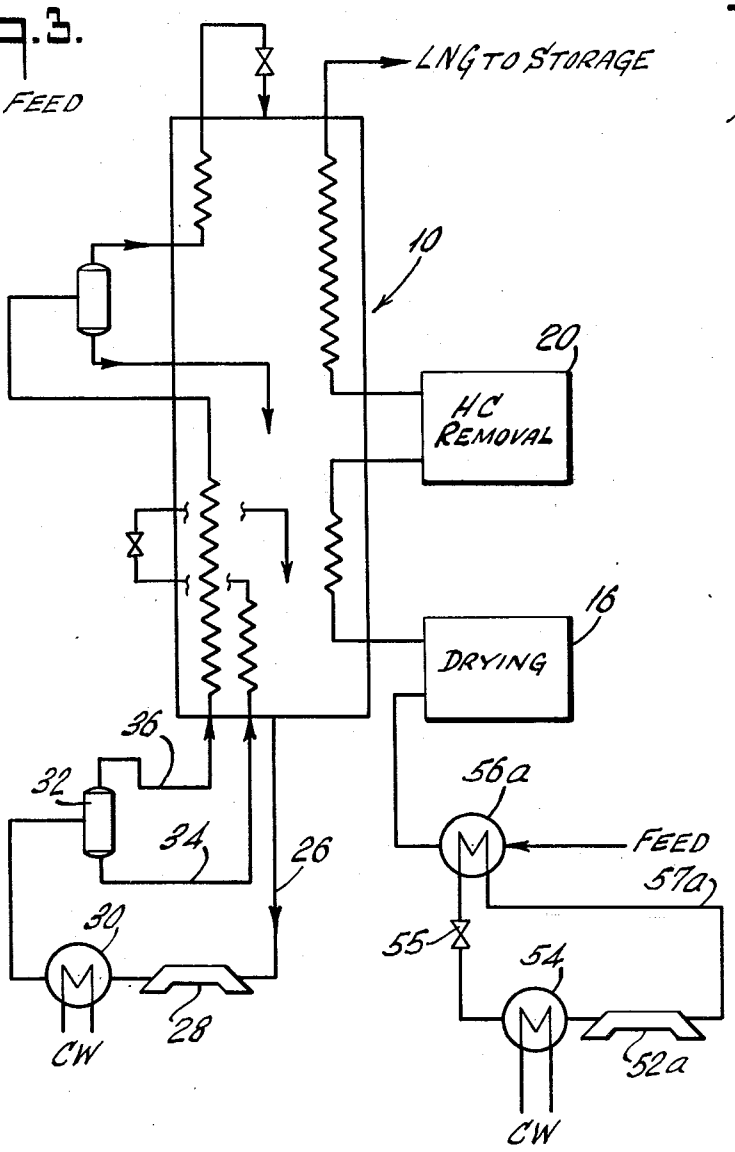
FIG. 3 illustrates one embodiment of the invention.

FIG. 3 illustrates the first preferred embodiment of the present invention wherein the pure MCR cycle of FIG. 1 and the cold-suction cycle of FIG. 2 are molded together. The independent refrigeration system corresponds in part to FIG. 2 and corresponding elements are labeled "__*a*". It cools only the incoming natural gas feed from ambient temperature down to the temperature at which water is removed, typically 70° F. Thereafter, the natural gas is cooled by the MCR refrigeration system until it is fully liquefied. The independent refrigeration system does not cool the warm MCR refrigerant as in the cold-suction cycle of FIG. 2. The MCR refrigeration system in this preferred embodiment does not typically operate with cold suction as in FIG. 2. Exchanger 10 returns the MCR refrigerant to the compressor 28 via conduit 26 at a temperature which, in general will be near ambient and warmer than the natural gas feed after the drying process.

It should be noted that, although propane is the preferred working fluid for the independent refrigeration system, others could be used. An essentially single component fluid is preferred since the temperature can be easily controlled.

This liquefaction process is not only simpler than the cold-suction cycle, but it can be shown by a detailed economic analysis to produce significant advantages not immediately evident upon inspection of the cycle. When one compares the overall compression requirements for the cold-suction cycle of FIG. 2 and the "chilled feed" variant of the pure MCR cycle in FIG. 3, it is found that the compression requirements for the "chilled feed" system of FIG. 3 are less than those for "cold-suction" cycle of FIG. 2; but this advantage is partially offset because more exchanger surface is required than for the "cold-suction" system. However, when one considers the costs of compression, heat exchanger surface, and utilities, it is found that the "chilled feed" MCR system of FIG. 3 is preferred to the "cold-suction" system of FIG. 2. It will also be appreciated that the chilled feed MCR system of FIG. 3 also represents a somewhat simpler system to operate and should have advantages in manning, maintenance, and in simplicity of operation.

Figure 4:
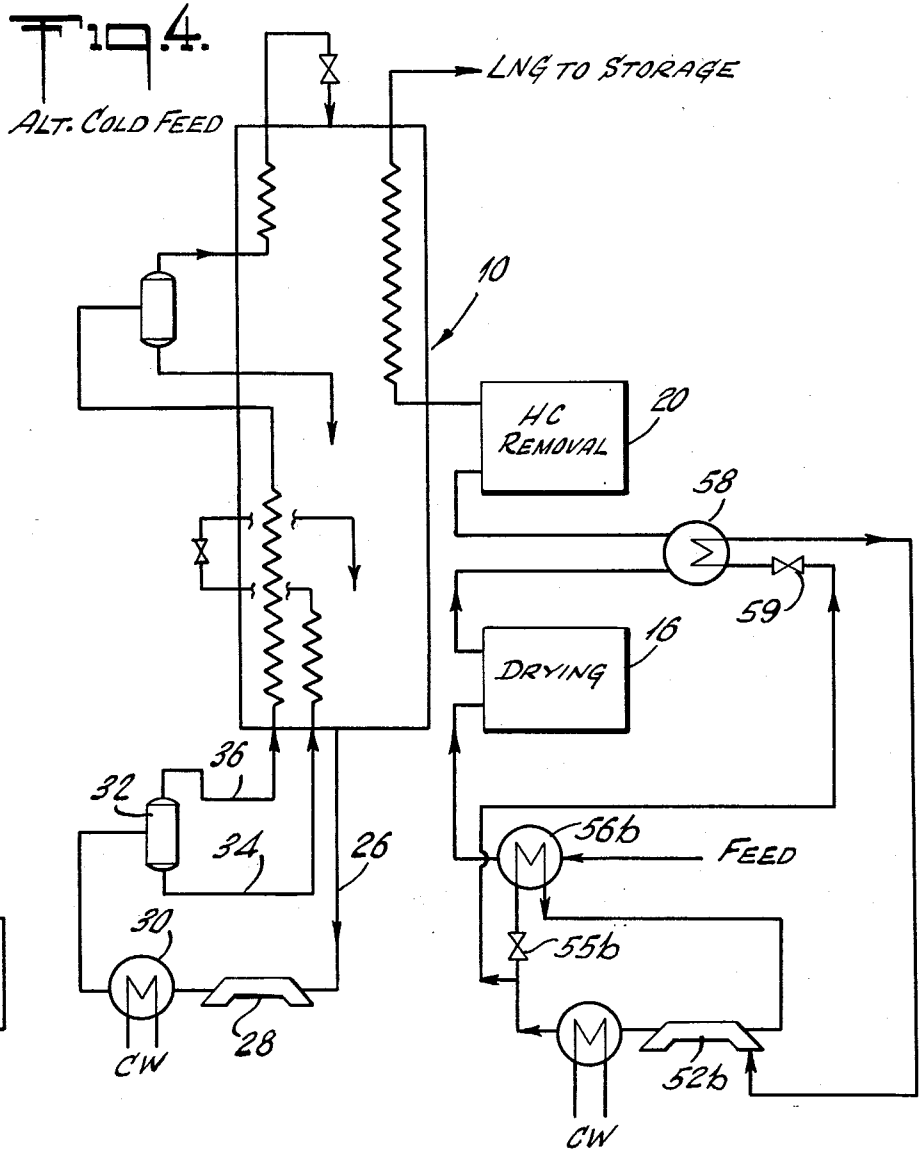
FIG. 4 illustrates an alternative embodiment of the invention.

In the alternative embodiment of the invention shown in FIG. 4, the feed chilling is extended beyond that done in FIG. 3. In FIG. 4, an additional lower temperature refrigeration loop is provided from the independent refrigeration system to further cool the natural gas feed after the drying step and until the heavy hydrocarbons have been removed 20. Thereafter the chilled natural gas is returned to the heat exchanger 10 in order to be further cooled and liquefied by the MCR refrigeration. As in the cycle of FIG. 3, the MCR refrigeration system is operated independently of the separate refrigeration system and operates at an optimum suction temperature which would ordinarily be near ambient and warmer than that of the prechilled feed reaching as it enters the heat exchanger 10. The two-stage independent refrigeration system of FIG. 4 provides refrigeration at two different temperatures selected for chilling the feed before drying 16 and before heavy hydrocarbon removal 20. Starting at the discharge of the compressor 52*b*, the refrigerant, again assumed to be propane, is condensed and the refrigeration load rejected to the environment by means of cooling water or air in exchanger 54*b*. After condensation, the refrigerant flows to the feed exchanger 56*b* and is flashed immediately upstream through valve 55*b*. After vaporization in exchanger 56*b*, the propane is returned to the compressor 52*b* as in FIG. 3. However, it will generally return to an intermediate stage in the compressor as shown here since its pressure will be higher than that of the lowest level refrigerant now to be discussed. Refrigerant also flows to the second feed chiller 58 where it is flashed through valve 59 to a lower pressure than that required for feed chilling in exchanger 56*b* prior to drying. Again, the natural gas is cooled by vaporising propane: and once vaporized, it returns to the suction of the compressor 52*b*. Since the temperature of chiller 58 is lower than that in chiller 56*b*, it establishes the suction pressure for the compressor 52*b*. The higher pressure vapor returning from the first feed chiller 56*b* returns to the compressor 52*b* at a location suitable to its pressure.

The foregoing description of the preferred embodiment is intended for illustration and information only and should not be considered to limit the scope of the invention, which is defined by the claims which follow.

What is claimed is:

1. A process for the liquefaction of a natural gas stream which may contain heavy hydrocarbons consisting of:

a. cooling said natural gas stream to ambient temperature by heat exchange with ambient temperature surroundings;

b. further cooling said natural gas stream from ambient temperature to below ambient temperature by heat exchange with a first closed cycle refrigeration system to the temperature at which said gas stream is dried, said first refrigeration system rejecting heat received from said natural gas to said ambient temperature surrounding during said cooling;

c. further cooling said natural gas stream from the temperature at which said gas stream is dried to a colder temperature at which heavy hydrocarbons which may be contained in said gas stream are removed, by heat exchange with said first closed cycle refrigeration system, said first refrigeration system rejecting heat received from said gas stream to said ambient temperature surroundings during said cooling;

d. thereafter cooling and liquefying said dried and heavy hydrocarbon removed gas by heat exchange with a second closed cycle refrigeration system having an operating fluid a multi-component refrigerant and said second closed cycle refrigeration system rejecting heat received from said natural gas only to said ambient temperature surroundings and without any heat transfer to said first refrigeration system.

2. A process for the liquefaction of a natural gas stream which may contain heavy hydrocarbons consisting of:

a. cooling said natural gas stream to ambient temperature by heat exchange with ambient temperature surroundings;

b. further cooling said natural gas stream from ambient temperature to below ambient temperature by heat exchange with a first closed cycle refrigeration system to the temperature at which said gas stream is dried, said first refrigeration system rejecting heat received from said natural gas to said ambient temperature surrounding during said cooling;

c. further cooling said natural gas stream from the temperature at which said gas stream is dried to a colder temperature at which heavy hydrocarbons which may be contained in said gas stream are removed, by heat exchange with a second closed cycle refrigeration system having a multi-component refrigerant operating fluid, said second closed cycle refrigeration system rejecting heat received from said natural gas to said ambient temperature surroundings without any heat transfer to said first refrigeration system;

d. thereafter cooling and liquefying said dried and heavy hydrocarbon removed gas by heat exchange with said second closed cycle refrigeration system.

3. The process of claim 2 wherein said working fluid is propane.

4. The process of claim 2 wherein said first independent refrigeration means is a closed loop refrigeration system employing an essentially single component as a working fluid with at least two pressure levels of vaporization.

* * * * *